US011338166B2

(12) United States Patent
Eida

(10) Patent No.: US 11,338,166 B2
(45) Date of Patent: May 24, 2022

(54) PHYSICAL STRETCHING APPARATUS

(71) Applicant: Isaac Eida, Atlantic Beach, NY (US)

(72) Inventor: Isaac Eida, Atlantic Beach, NY (US)

( * ) Notice: Subject to any disclaimer, the term of this patent is extended or adjusted under 35 U.S.C. 154(b) by 0 days.

(21) Appl. No.: 16/932,655

(22) Filed: Jul. 17, 2020

(65) Prior Publication Data

US 2022/0016463 A1 Jan. 20, 2022

(51) Int. Cl.
*A63B 21/04* (2006.01)
*A63B 21/00* (2006.01)
(Continued)

(52) U.S. Cl.
CPC .... *A63B 21/0442* (2013.01); *A63B 21/00061* (2013.01); *A63B 21/0557* (2013.01);
(Continued)

(58) Field of Classification Search
CPC ..... A63B 21/00058; A63B 21/00061; A63B 21/00065; A63B 21/00069; A63B 21/00072; A63B 21/00076; A63B 21/00178; A63B 21/00185; A63B 21/002; A63B 21/0023; A63B 21/012; A63B 21/015; A63B 21/018; A63B 21/02; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/065; A63B 21/068; A63B 21/08; A63B 21/15; A63B 21/151; A63B 21/152; A63B 21/154; A63B 21/155; A63B 21/156; A63B 21/157; A63B 21/159; A63B 21/16; A63B 21/1609; A63B 21/1618; A63B 21/1627; A63B 21/1636; A63B 21/1645; A63B 21/1654; A63B 21/1663; A63B 21/4011; A63B 21/4013; A63B 21/4015; A63B 21/4027; A63B 21/4033;
(Continued)

(56) References Cited

U.S. PATENT DOCUMENTS 3,752,474 A * 8/1973 Macabet ..... A63B 23/03575 482/131
3,979,114 A * 9/1976 Godina ..... A63B 23/0355 482/131
(Continued)

*Primary Examiner* — Gary D Urbiel Goldner
(74) *Attorney, Agent, or Firm* — Ariel S. Bentolila; Bay Area IP Group, LLC

(57) ABSTRACT

A physical stretching apparatus having: an anchor strap, wherein the anchor strap is configured to be operable for attaching the apparatus to any stationary object; an anchor joint, the anchor joint is configured to attach the anchor strap and a rope implement; an elastic looped strap configured to secure the apparatus to various points on a user; an attachment contrivance, wherein the attachment contrivance is configured to be operable for attaching the elastic looped strap to the rope implement; a rope lock that is configured to permit the rope implement to pass in one direction when pulled and restricts the rope implement from passing in an opposite or reverse direction; a release mechanism that disables this restriction; and a sliding restrainer, wherein the sliding restrainer is configured to be operable for adjusting a size of the looped strap.

13 Claims, 15 Drawing Sheets

(51) Int. Cl.
*A63B 21/055* (2006.01)
*A63B 21/16* (2006.01)

(52) U.S. Cl.
CPC ..... *A63B 21/154* (2013.01); *A63B 21/1663* (2013.01); *A63B 21/4013* (2015.10); *A63B 2208/0252* (2013.01)

(58) Field of Classification Search
CPC ..... A63B 2023/006; A63B 23/035; A63B 23/03508; A63B 23/04; A63B 23/0405; A63B 23/0482; A63B 23/0494; A63B 23/08; A63B 27/00; A63B 27/02; A63B 27/04; A63B 29/00; A63B 29/02; A63B 29/08; A63B 69/0048; A63B 69/0057; A63B 69/0059; A63B 69/0062; A63B 2208/0242; A63B 2208/0252; A63B 2210/00; A63B 2210/50; A63B 2225/09; A63B 2225/093
See application file for complete search history.

(56) References Cited

U.S. PATENT DOCUMENTS 4,060,240 A * 11/1977 Dunston ..... A63B 21/1663 482/131
5,067,709 A 11/1991 Christianson
5,176,602 A * 1/1993 Roberts ..... A63B 7/02 482/129
5,545,113 A * 8/1996 Bobich ..... A63B 21/0004 482/124
5,556,369 A * 9/1996 Roberts ..... A63B 17/00 482/131
5,595,559 A * 1/1997 Viel ..... A61H 1/0237 482/114
5,813,954 A * 9/1998 Wilkinson ..... A63B 21/0004 482/124
5,857,949 A * 1/1999 Tebbe ..... A63B 23/0211 482/140
6,110,083 A 8/2000 Riser
6,113,564 A * 9/2000 McGuire ..... A61H 1/0229 482/131
6,338,700 B1 1/2002 Pollock
6,505,384 B1 * 1/2003 Renton ..... B63B 21/04 114/218
6,705,974 B1 * 3/2004 Tardif ..... A63B 21/068 482/148
7,364,555 B1 * 4/2008 Davidson ..... A61H 1/0274 482/131
7,381,173 B2 * 6/2008 Planke ..... A63B 7/02 24/130
9,326,908 B2 * 5/2016 Scott ..... A63B 21/154
10,478,662 B2 * 11/2019 Davis ..... A61H 1/0237
10,556,145 B2 * 2/2020 Chaudhuri ..... A63B 23/03575
10,625,109 B1 * 4/2020 Bytella ..... A63B 21/00185
2002/0022555 A1 2/2002 Nesci
2003/0196853 A1 * 10/2003 LeBeau ..... A62B 1/14 182/5
2008/0318742 A1 * 12/2008 Califano ..... A63B 23/0494 482/124
2010/0292056 A1 * 11/2010 Birch ..... A63B 21/00185 482/129
2011/0034307 A1 * 2/2011 Eddy ..... A63B 21/4015 482/131
2011/0207586 A1 * 8/2011 Whyatt ..... A63B 21/4017 482/139
2014/0315695 A1 * 10/2014 Scott ..... A61H 1/0274 482/91
2016/0107005 A1 * 4/2016 Rogelja ..... A62B 35/0043 182/5
2016/0287922 A1 * 10/2016 Baudhuin ..... A63B 23/03533
2017/0189725 A1 * 7/2017 Malcolm ..... A63B 29/02
2018/0021602 A1 * 1/2018 Rogelja ..... A62B 1/14 188/65.2
2018/0311526 A1 * 11/2018 Eddy ..... A63B 21/154
2019/0217141 A1 * 7/2019 Ott ..... A63B 21/4043
2019/0299048 A1 * 10/2019 Pensivy ..... A63B 21/0442

* cited by examiner

PHYSICAL STRETCHING APPARATUS

CROSS-REFERENCE TO RELATED APPLICATIONS

Not applicable.

RELATED CO-PENDING U.S. PATENT APPLICATIONS

Not applicable.

INCORPORATION BY REFERENCE OF SEQUENCE LISTING PROVIDED AS A TEXT FILE

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

BACKGROUND OF THE RELEVANT PRIOR ART

One or more embodiments of the invention generally relate to fitness equipment. More particularly, certain embodiments of the invention relate to a physical stretching apparatus.

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Fitness is an important aspect of a healthy life, and can have many physical as well as mental benefits for one who incorporates exercise into their daily routine. Even simple activities can have negative effects on the body without a proper warm up and cool down. Prior to, and perhaps more importantly after a physical activity, performing stretching activities may serve to improve recovery time as well as prevent injury. Additionally, stretching may increase flexibility and range of motion, allowing a person to more efficiently use their muscles and may, in many cases, increase athletic performance.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that while unassisted stretching may be effective, assisted stretching may provide additional benefit by reducing muscle strain while allowing a person to increase their range of motion further than if the person was to stretch on their own. Home stretching devices may be able to provide these benefits without the need to find another person to perform assisted stretching. Many of these devices require the user to put in additional manual effort to properly perform assisted stretching.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIGS. 3A-3B illustrate a top portion of an exemplary physical stretching apparatus, in accordance with an embodiment of the present invention, wherein FIG. 3A shows a top portion with an exemplary rope lock and FIG. 3B shows a top portion with an exemplary stand-alone pulley and rope cleat;

FIG. 6A-6B illustrate exemplary inline tension apparatuses, in accordance with an embodiment of the present invention, wherein FIG. 6A shows an exemplary inline elastic strap and FIG. 6B shows an exemplary inline spring;

Figure 1A:
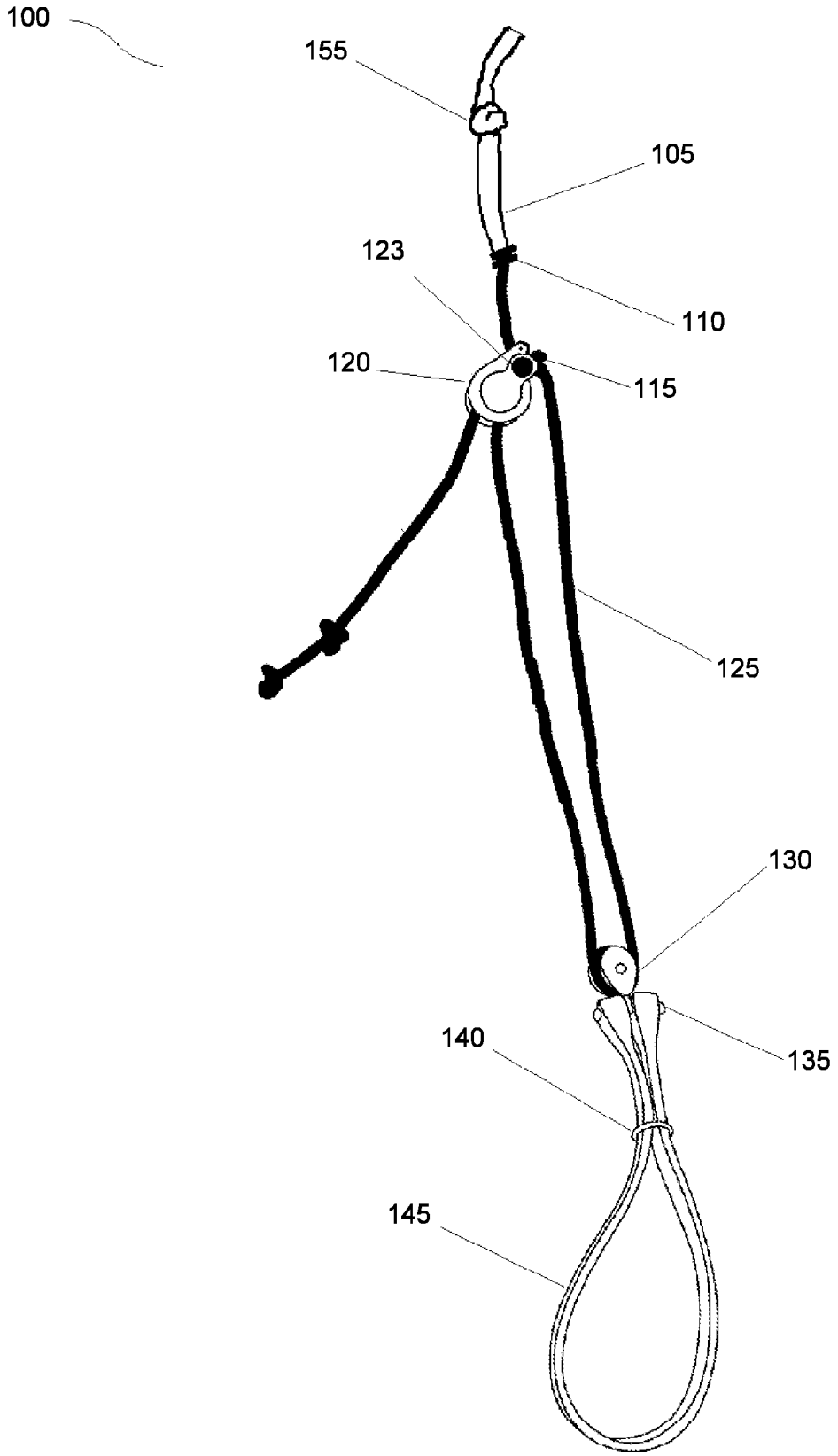
FIG. 1A illustrates an exemplary physical stretching apparatus, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settled law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQd 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, the term 'substantially' is well recognized in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. § 112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to 'avoid a strict numerical boundary to the specified parameter, see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will be described in detail below with reference to embodiments thereof as illustrated in the accompanying drawings.

References to a "device," an "apparatus," a "system," etc., in the preamble of a claim should be construed broadly to mean "any structure meeting the claim terms" exempt for any specific structure(s)/type(s) that has/(have) been explicitly disavowed or excluded or admitted/implied as prior art in the present specification or incapable of enabling an object/aspect/goal of the invention. Furthermore, where the present specification discloses an object, aspect, function, goal, result, or advantage of the invention that a specific prior art structure and/or method step is similarly capable of performing yet in a very different way, the present invention disclosure is intended to and shall also implicitly include and cover additional corresponding alternative embodiments that are otherwise identical to that explicitly disclosed except that they exclude such prior art structure(s)/step(s), and shall accordingly be deemed as providing sufficient disclosure to support a corresponding negative limitation in a claim claiming such alternative embodiment(s), which exclude such very different prior art structure(s)/step(s) way(s).

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" include the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of or interaction, with some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising" And "contain" and variations of them—Such terms are open-ended and mean "including but not limited to". When employed in the appended claims, this term does not foreclose additional structure or steps. Consider a claim that recites: "A memory controller comprising a system cache . . . ." Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. .sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

All terms of exemplary language (e.g., including, without limitation, "such as", "like", "for example", "for instance", "similar to", etc.) are not exclusive of any other, potentially, unrelated, types of examples; thus, implicitly mean "by way of example, and not limitation . . . ", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" and "consisting of" limits the scope of a claim to the specified elements or method steps, plus those that do not materially affect the basis and novel characteristic(s) of the claimed subject matter (see Norian Corp. v Stryker Corp., 363 F.3d 1321, 1331-32, 70 USPQ2d 1508, Fed. Cir. 2004). Moreover, for any claim of the present invention which claims an embodiment "consisting essentially of" or "consisting of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of," and "consisting essentially of," where one of these three terms is used herein, the disclosed and claimed subject matter may include the use of either of the other two terms. Thus in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of" only the elements recited in the original "comprising" embodiment to the exclusion of all other elements.

Moreover, any claim limitation phrased in functional limitation terms covered by 35 USC § 112(6) (post AIA 112(f)) which has a preamble invoking the closed terms "consisting of," or "consisting essentially of," should be understood to mean that the corresponding structure(s) disclosed herein define the exact metes and bounds of what the so claimed invention embodiment(s) consists of, or consisting essentially of, to the exclusion of any other elements which do not materially affect the intended purpose of the so claimed embodiment(s).

Devices or system modules that are in at least general communication with each other need not be in continuous communication with each other, unless expressly specified otherwise. In addition, devices or system modules that are in at least general communication with each other may communicate directly or indirectly through one or more intermediaries. Moreover, it is understood that any system components described or named in any embodiment or claimed herein may be grouped or sub-grouped (and accordingly implicitly renamed) in any combination or sub-combination as those skilled in the art can imagine as suitable for the particular application, and still be within the scope and spirit of the claimed embodiments of the present invention. For an example of what this means, if the invention was a controller of a motor and a valve and the embodiments and claims articulated those components as being separately grouped and connected, applying the foregoing would mean that such an invention and claims would also implicitly cover the valve being grouped inside the motor and the controller being a remote controller with no direct physical connection to the motor or internalized valve, as such the claimed invention is contemplated to cover all ways of grouping and/or adding of intermediate components or systems that still substantially achieve the intended result of the invention.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

FIG. 1A illustrates an exemplary physical stretching apparatus, in accordance with an embodiment of the present invention. Physical stretching apparatus 100 may be adapted to be used with a door, as depicted in FIG. 1A. Anchor strap 105 may be inserted by the user into a gap between a door slab and a door frame while the door is open, and affixing an anchor knot 155 or similar obstacle in anchor strap 105 section extending on the other side of the door to prevent anchor strap 105 from slipping through, as said gap is minimized when the door is shut, and closing the door so that physical stretching apparatus 100 may be held in place. It should be appreciated by one skilled in the art that anchor strap 105 may be used to anchor to other objects, and is not limited to being used with a door. For example, without limitation, anchor strap 105 may be anchored to a pole, a secured desk, a wall, etc. via any means known in the art. Anchor strap 105 may be attached to one end of a rope implement 125 of physical stretching apparatus 100 via anchor joint 110. Anchor joint 110 may comprise for example, without limitation, a crimp, a knot, a swivel, a ring, a hook snap, a carabiner etc. to join anchor strap 105 to rope implement 125. Fastening knot 115 may be inserted in rope implement 125 to attach rope lock 120 to anchor joint 110. Rope lock 120 may be a special type of pulley which permits a rope when pulled to pass in one direction while restricting it from passing in the opposite direction, and comprises a release mechanism 123 that disables said restriction. The other end of rope implement 125 may pass through attachment contrivance 130 then rope lock 120, in a manner which may act as a pulley system providing a two to one mechanical advantage to the user, allowing the user to adjust physical stretching apparatus 100 with reduced manual effort. As will be appreciated by one skilled in the art, although a two to one mechanical advantage pulley system is depicted, physical stretching apparatus 100 may be used with any type of pulley system such as, for example, a one to one mechanical advantage pulley system etc Additionally, rope lock 120 may be locked in place, allowing a user to lock the user in a stretching position without continuous physical strain. In accordance with an embodiment of the current invention, rope lock 120 may be attached to anchor joint 110 via fastening knot 115 in rope implement 125 in a manner that creates an obstacle preventing rope lock 120 from slipping past fastening knot 115, thereby holding rope lock 120 attached in series to anchor joint 110 when under tension. As will be appreciated by one skilled in the art although an obstacle in rope implement 125 is depicted, any other means of attaching rope lock 120 in series with anchor joint 110 may be used, such as but not limited to attaching rope lock 120 directly to fastening knot 115 or to anchor joint 110 etc. Attachment contrivance 130 may be any means known in the art for attaching to looped strap 145 via strap joint 135 and for passing through rope implement 125 such as, but not limited to, a pulley, a swivel snap, a hook snap, a ring, a carabiner, etc. Strap joint 135 may be any means known in the art for attaching to attachment contrivance 130 and to looped strap 145, such as, but not limited to, a nut and bolt combination, a screw, a cotter pin, a Chicago screw, a rivet, a fastener, etc. Attachment contrivance 130 and strap joint 135 may be without limitation attached by permanent bonding of the 2 implements or by fabrication as a single implement. Looped strap 145 may be used to secure physical stretching apparatus 100 to various points on a user, such as, but not limited to, the user's knee, foot, ankle, thigh, head, arm etc. Looped strap 145 may comprise an elastic looped strap to provide flexibility for tensioning and relaxing muscles while muscles are stretched to simulate techniques of trainer assisted stretching. To accommodate for different limbs, the size of the opening of looped strap 145 may be adjusted via sliding restrainer 140. Sliding restrainer 140 may slide up and down looped strap 145 to create a larger or smaller opening, respectively, depending on the needs of the user. Sliding restrainer 140 may quickly adjust the size of looped strap 145 to grasp body parts of different sizes, to minimize effort to transition between stretch routines and to enable the device to be used for various stretching routines. Sliding restrainer 140 may comprise, for example, without limitation, a short piece of tubing, a ring, a buckle, etc.

Figures 1B, 1C:
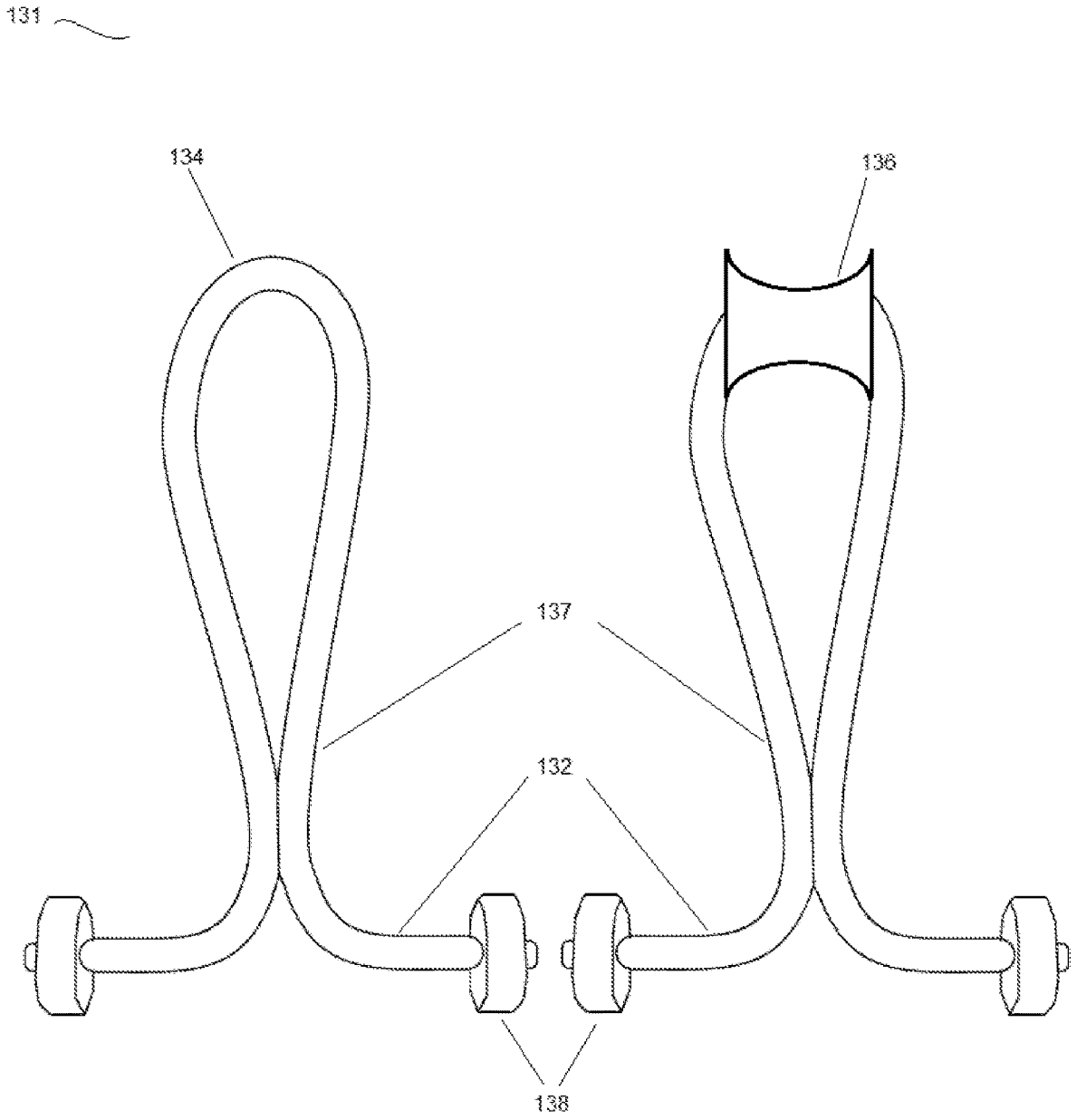
FIG. 1B and FIG. 1C illustrates an exemplary attachment implement, in accordance with an embodiment of the present invention.

FIG. 1B and FIG. 1C illustrates an exemplary attachment implement, in accordance with an embodiment of the present invention. Attachment implement 131 is an exemplary attachment contrivance and strap joint as a single implement. In one embodiment, attachment implement 131 may comprise, but not limited to, a rope eye 134 for engaging rope implement 125, a shaft 137 which may be welded, tied or wrapped with a steel string, an arm 132 and a locking nut 138 for engaging looped strap 145, and rope implement wheel 136 that may enable a smooth transitioning of rope implement 125. Rope implement wheel 136 may be installed in the rope eye 134 upon request.

Figure 2:
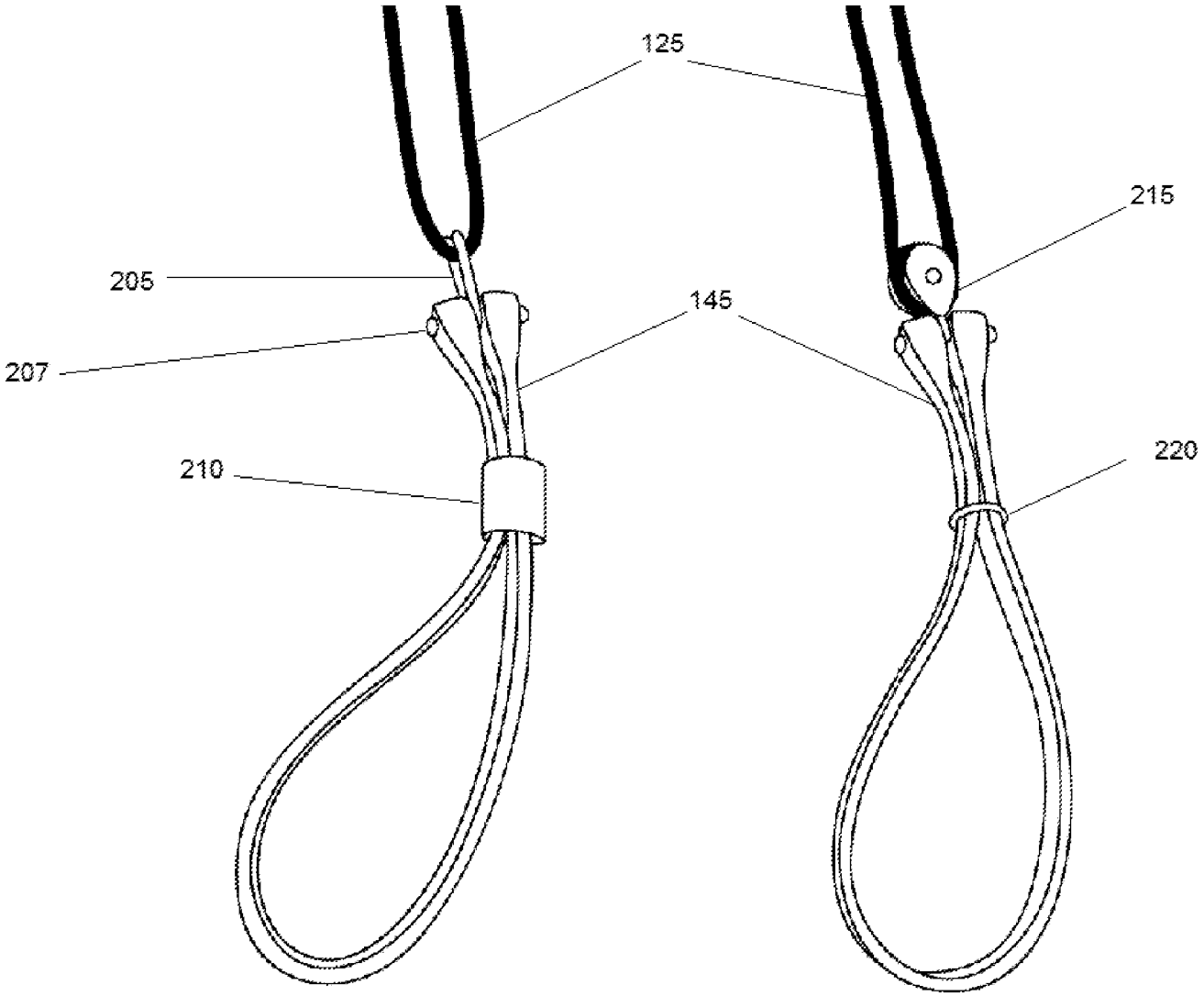
FIG. 2 illustrates a bottom portion of an exemplary physical stretching apparatus, in accordance with an embodiment of the present invention.

FIG. 2 illustrates a bottom portion of an exemplary physical stretching apparatus, in accordance with an embodiment of the present invention. With reference to both FIG. 1A and FIG. 2, Physical stretching apparatus 100 may be used with several different embodiments. For example, rope implement 125 may be attached to looped strap 145 via, for example, without limitation, carabiner 205 or pulley 215. Additionally, any type of restraining slider may be used to adjust the size of the opening of looped strap 145, such as, without limitation, tubing 210 or ring 220. Looped strap 145 may comprise of an elastic material, such as, but not limited to rubber bungee cord, wide elastic band, etc., providing flexible resistance to the user while performing a stretch, thus simulating a particular technique of trainer-assisted stretching. Looped strap 145 may also comprise of a non-elastic material, thus simulating an alternative technique of trainer assisted stretching.

Figure 3B:
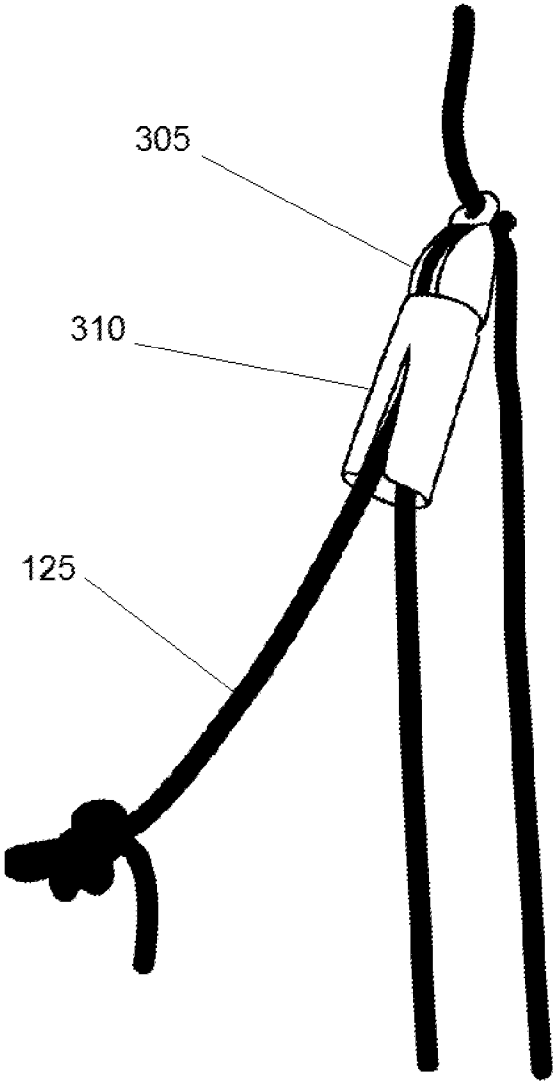
Figure 3A:
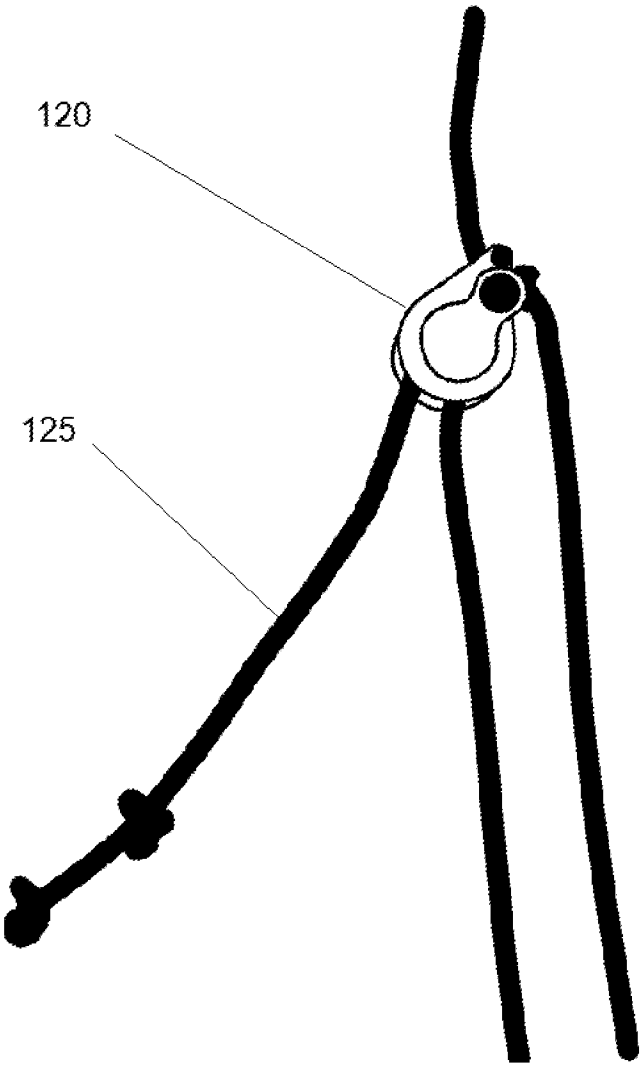

FIGS. 3A-3B illustrate a top portion of an exemplary physical stretching apparatus, in accordance with an embodiment of the present invention, wherein FIG. 3A shows a top portion with an exemplary rope lock and FIG. 3B shows a top portion with an exemplary stand-alone pulley and rope cleat. Referring now to both FIG. 1A and FIG. 3A, rope lock 120 may be used with rope implement 125 to allow a user to adjust physical stretching apparatus 100 depending on the needs of the user. Rope lock 120 may be locked in place, allowing the user to perform a stretch without the additional physical strain of holding rope implement 125. Now referring to both FIG. 1A and FIG. 3B, alternative means of attaching to and locking rope implement 125 may also be considered within the scope of the invention. For example, without limitation, pulley 305 and rope cleat 310 may be used and provide similar functionality to rope lock 120. Rope implement 125 may pass through attachment contrivance 130 and pulley 305, providing a two to one mechanical advantage to the user, and rope implement 125 may also be locked in place via rope cleat 310 to allow the user to perform a stretch without the additional physical strain of holding rope implement 125.

Figure 4A:
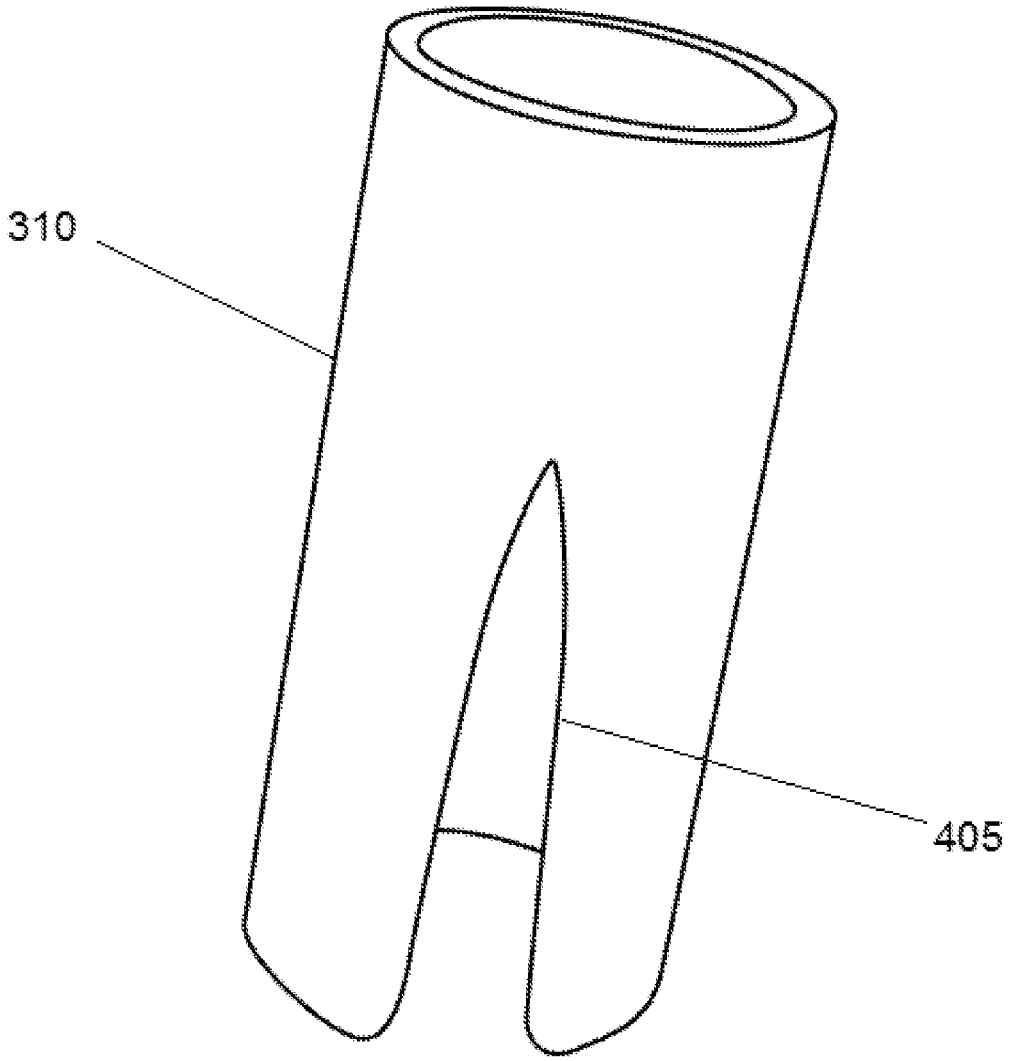
FIG. 4A illustrates an exemplary rope cleat, in accordance with an embodiment of the present invention.

FIG. 4A illustrates an exemplary rope cleat, in accordance with an embodiment of the present invention. With reference to both FIG. 3B and FIG. 4A, rope cleat 310 may comprise, for example, without limitation, a piece of tubing with cut out 405. Rope may pass through rope cleat 310 and locked in place by guiding rope implement 125 into cut out 405, locking the rope in place. In another embodiment of rope cleat 310, said rope cleat 310 may comprise a close-fitting channel for passing rope implement 125 and comprising a cam clamp to jam rope implement 125 within said channel, locking it in place. As will be appreciated by one skilled in the art, rope cleat 310 may be composed of any material, such as, but not limited to, plastic, wood, aluminum, iron, steel, etc.

Figure 4B:
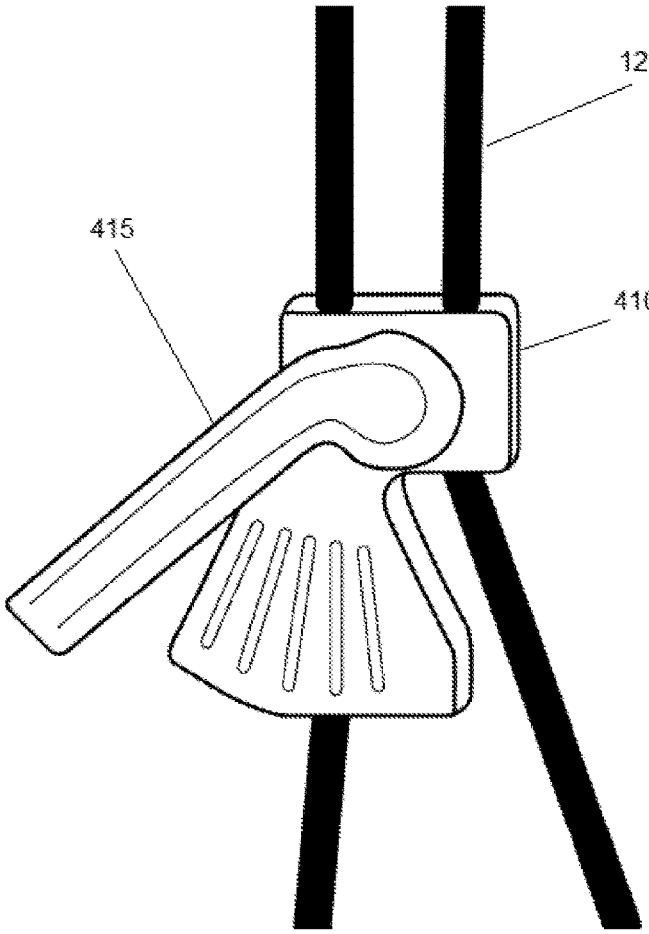
FIG. 4B and FIG. 4C illustrates an exemplary rope cleat, in accordance with an embodiment of the present invention.
Figure 4C:
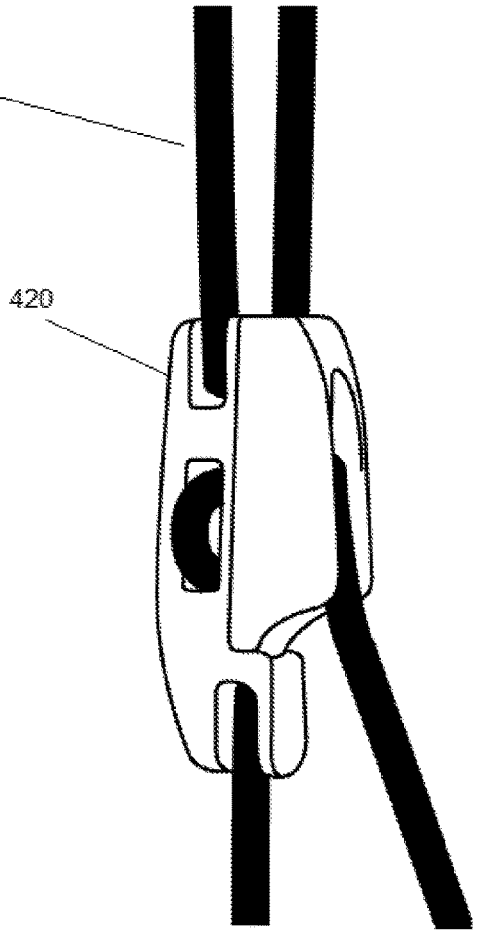

FIG. 4B and FIG. 4C illustrates an exemplary rope cleat, in accordance with an embodiment of the present invention. With reference to FIG. 4B, rope 125 may pass through rope cleat 410 and locked in place by handle 415. With reference to FIG. 4C, rope 125 may pass through and automatically locked in place by rope cleat 420 with no handles or locks. It is easy to adjust the cleat along the rope by simply releasing tension off the loops and moving the cleat along the rope.

Figure 5C:
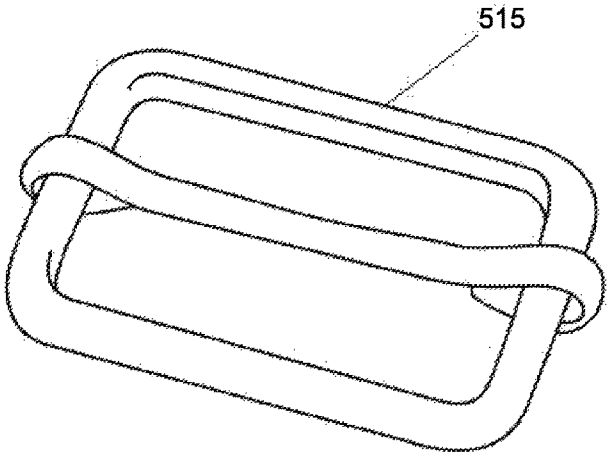
FIG. 5A-5C illustrate exemplary sliding restrainers, in accordance with an embodiment of the present invention.
Figure 5B:
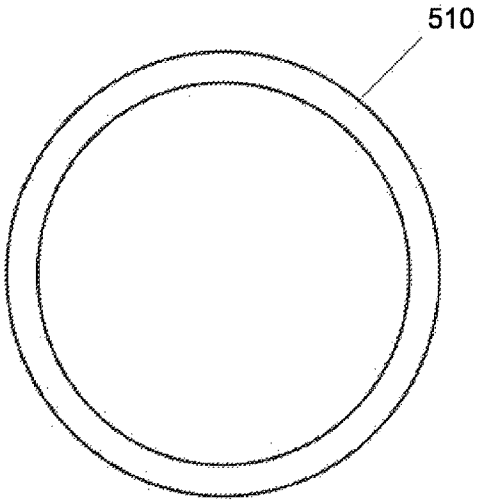
Figure 5A:
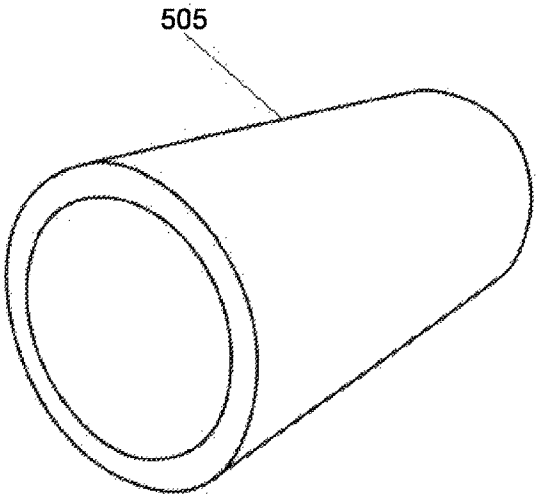

FIG. 5A-5C illustrate exemplary sliding restrainers, in accordance with an embodiment of the present invention. Many different sliding restrainers may be used with physical stretching apparatus 100, and provide a user with the ability to attach physical stretching apparatus 100 to various points on a user's body. With reference to FIG. 5A, tubing 505 may be used as a sliding restrainer (For example, 210, as shown in FIG. 2). Tubing 505 may be composed of, for example, without limitation, rubber, polymers, plastic, etc., With reference to FIG. 5B and FIG. 5C, other types of restrainers may also be used, such as, without limitation, ring 510 or buckle 515. As will be appreciated by one skilled in the art, ring 510 and buckle 515 may be composed of any material, such as, but not limited to, copper, aluminum, iron, steel, wood, plastic, etc.

Figure 6A:
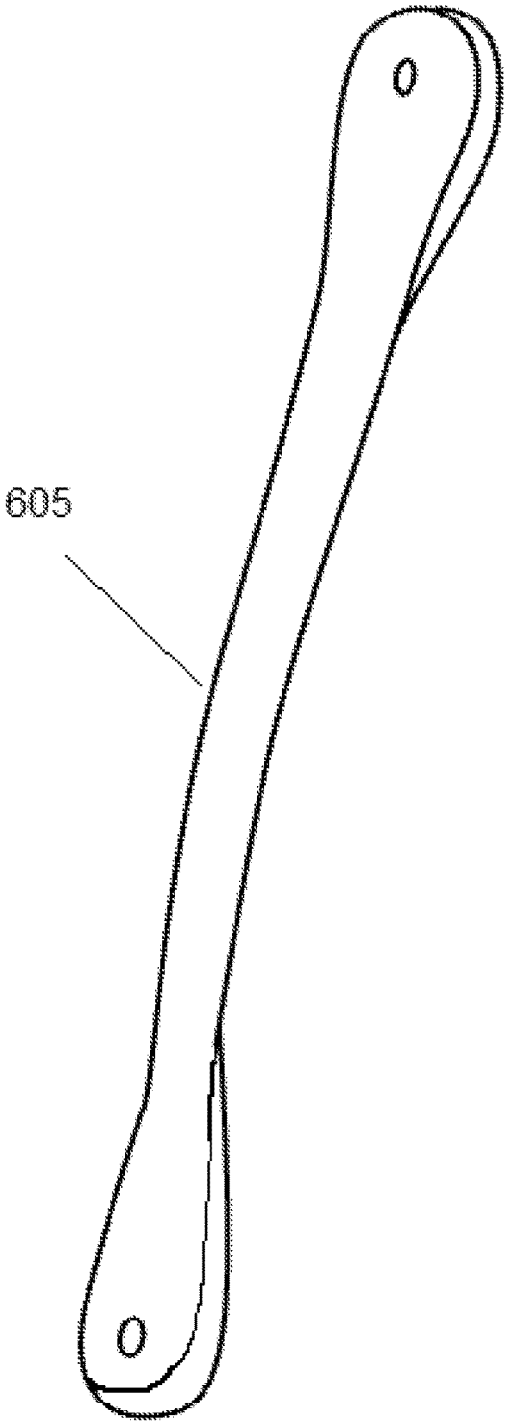
Figure 6B:
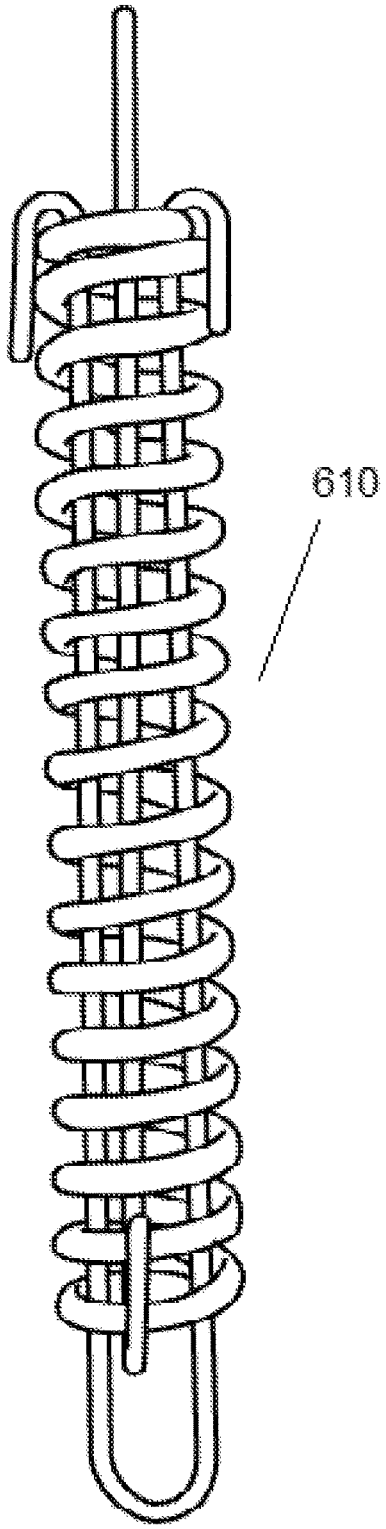

FIG. 6A-6B illustrate exemplary inline tension apparatuses, in accordance with an embodiment of the present invention, wherein FIG. 6A shows an exemplary inline elastic strap and FIG. 6B shows an exemplary inline spring. Inline tension apparatuses may be used with physical stretching apparatus 100 to provide elastic tension that may mimic a particular technique of trainer assisted stretching without needing to use an elastic material for looped strap 145. Inline tension apparatuses may be inserted serially at, for example, without limitation, anchor joint 110 or strap joint 135. Referring now to both FIG. 6A and FIG. 6B, elastic strap 605 and/or spring 610 may be used as inline tension apparatuses. In one embodiment, elastic strap 605 or spring 610 and rope lock 120 of physical apparatus 100 may be attached to anchor joint 110. In another embodiment, one end of rope implement 125 may be attached to looped strap 145 via attachment contrivance 130 at strap joint 135 or by any means known in the art, with the other end of rope implement 125 passing through rope lock 120.

Figure 7:
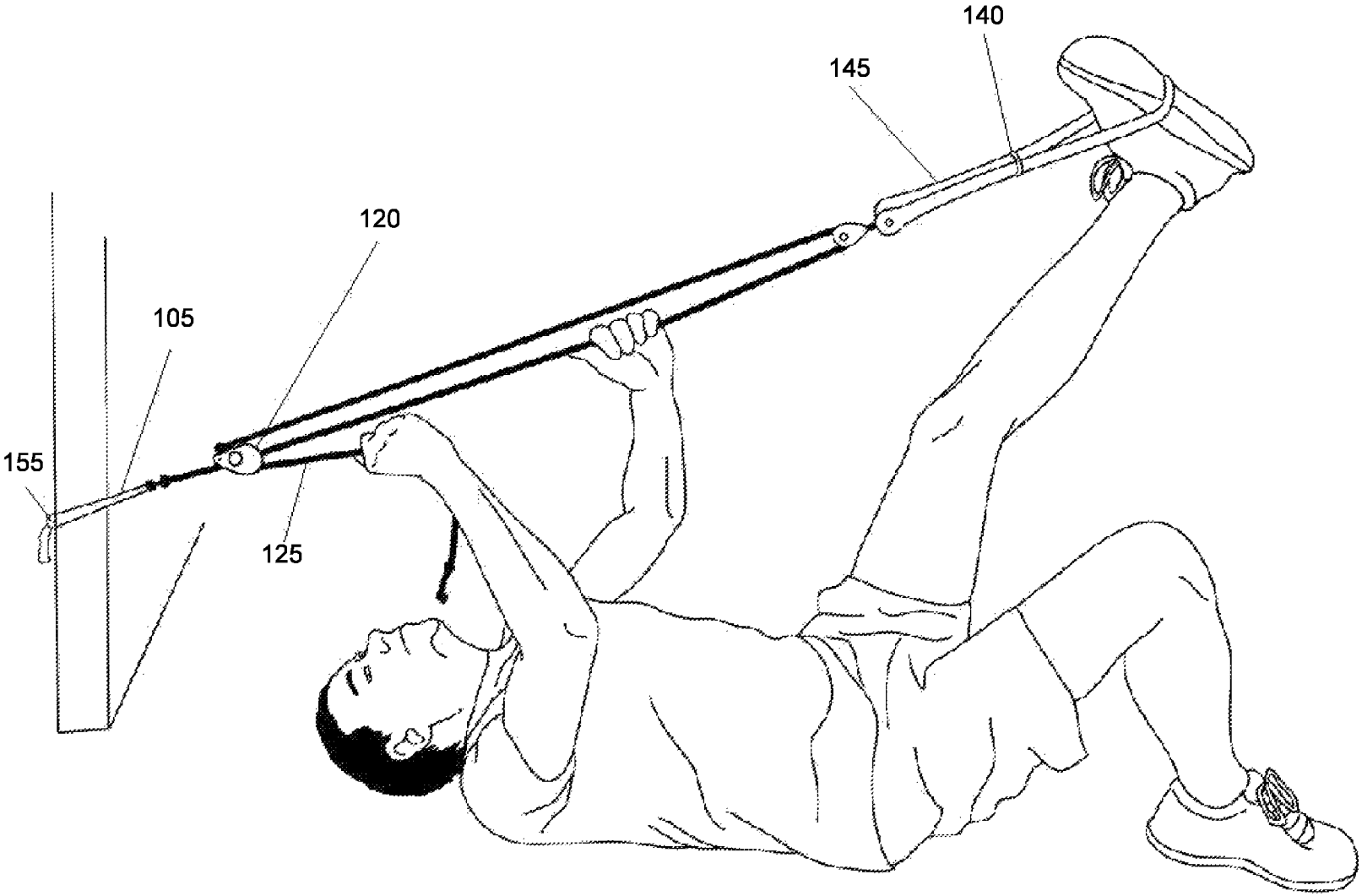
FIG. 7 illustrates an exemplary physical stretching apparatus being set up for a hamstring stretch, in accordance with an embodiment of the present invention.

FIG. 7 illustrates an exemplary physical stretching apparatus being set up for a hamstring stretch, in accordance with an embodiment of the present invention. With reference to both FIG. 1A and FIG. 7, physical stretching apparatus 100 may be initially set up by placing anchor strap 105 in a gap between a door panel and a door frame, and shutting the door to secure anchor strap 105 in place. To perform a hamstring stretch, a user may lie perpendicular to the door panel with their feet furthest from the door. The user may insert the user's foot into looped strap 145 and adjust sliding retainer 140 so that looped strap 145 may securely fit over the user's foot. The user may adjust physical stretching apparatus 100 by pulling on the loose end of rope implement 125 to achieve a desired stretched position. Or, by giving more slack to the loose end of rope 125 by simultaneously pulling on the loose end of rope 125 and activating the release mechanism of rope lock 120. Once in proper stretching position, the user may deactivate the release mechanism of rope lock 120 and release the loose end of rope 125, completing the initial set up of physical stretching apparatus 100 in performing a hamstring stretch.

Figure 8:
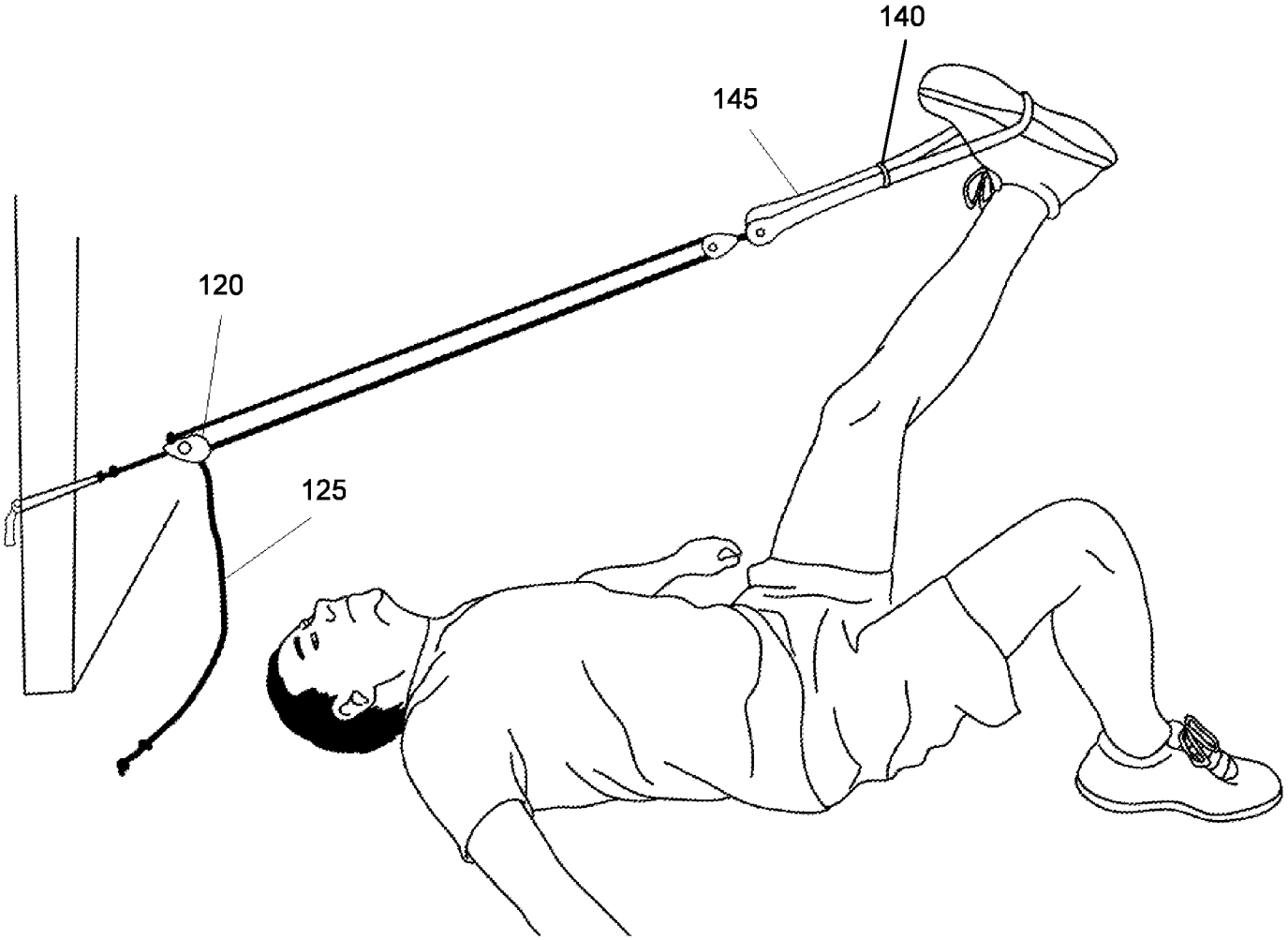
FIG. 8 illustrates an exemplary physical stretching apparatus used for a hamstring stretch, in accordance with an embodiment of the present invention.

FIG. 8 illustrates an exemplary physical stretching apparatus used for a hamstring stretch, in accordance with an embodiment of the present invention. With reference to both FIG. 1A and FIG. 8, the user is now depicted performing a hamstring stretch using physical stretching apparatus 100. The user may hold the user's leg in the stretched hamstring position for a desired period of time or engage in alternating periods of leg tensioning and relaxation to counteract the elasticity of looped strap 145, simulating a particular technique of trainer assisted stretching. As rope lock 120 is locked in place, the user no longer needs to hold on to rope implement 125 to perform the hamstring stretch, reducing the physical strain of the user.

Figure 9:
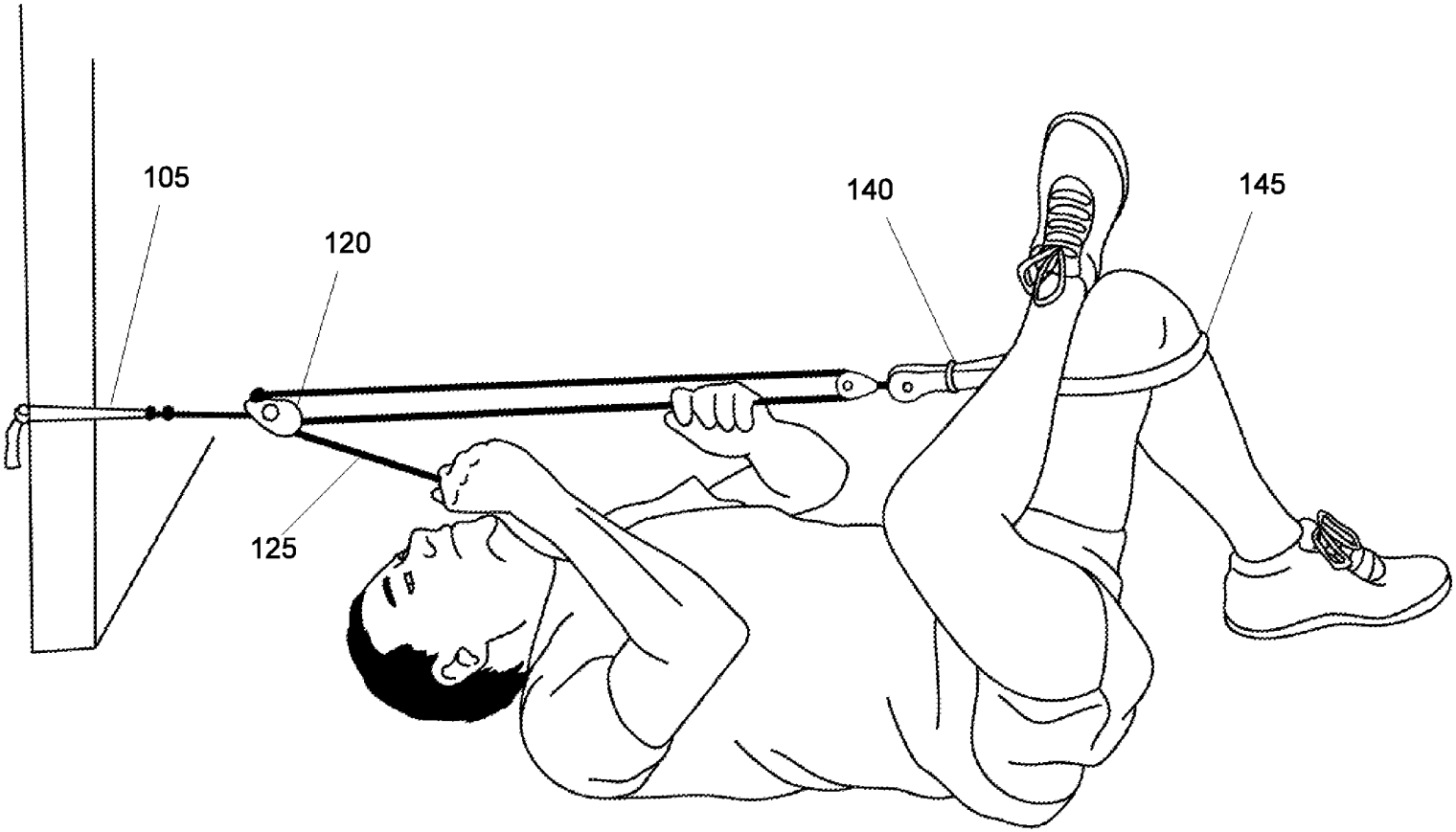
FIG. 9 illustrates an exemplary physical stretching apparatus being set up for a gluteal stretch, in accordance with an embodiment of the present invention.
Figure 10:
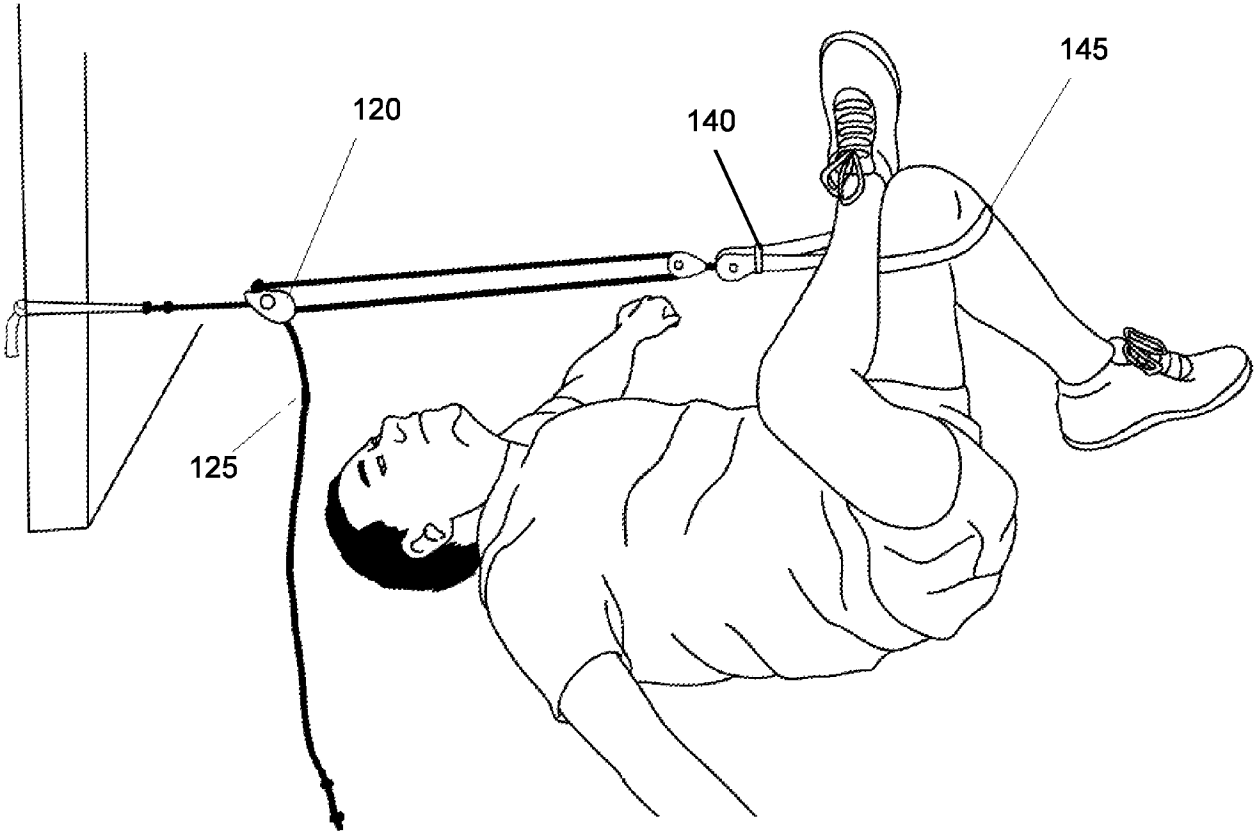
FIG. 10 illustrates an exemplary physical stretching apparatus used for a gluteal stretch, in accordance with an embodiment of the present invention.

FIG. 9 illustrates an exemplary physical stretching apparatus being set up for a gluteal stretch, in accordance with an embodiment of the present invention. Similar to setting up a hamstring stretch, a user may set up a gluteal stretch using physical stretching apparatus 100. With reference to both FIG. 1A and FIG. 9, a user may anchor physical stretching apparatus 100 to a door via anchor strap 105, as described above, and lie perpendicular to the door with the user's feet furthest from the door panel. To set up for a gluteal stretch, the user may insert the user's knee into looped strap 145 and adjust sliding restrainer 140 accordingly. The user may then place their opposite ankle on the knee in looped strap 145, as depicted in FIG. 9. The user may then pull on the loose end of rope implement 125 to pull the user's opposite ankle towards the door to achieve the desired stretched position. Once in proper stretched position the user may release the loose end of rope implement 125 completing the initial set up of physical stretching apparatus 100 in performing a gluteal stretch FIG. 10 illustrates an exemplary physical stretching apparatus used for a gluteal stretch, in accordance with an embodiment of the present invention. With reference to both FIG. 1A and FIG. 10, the user is now depicted performing a gluteal stretch using physical stretching apparatus 100. The user may hold the user's leg in the stretched position for a desired period of time or engage in alternating periods of leg tensioning and relaxation to counteract the elasticity of looped strap 145, simulating a particular technique of trainer assisted stretching. As rope lock 120 is locked in place, the user may release rope implement 125, requiring less physical effort to perform the gluteal stretch. After the user has finished performing the gluteal stretch, the user may disengage from apparatus 100 by simultaneously pulling on the loose end of rope implement 125 and activating release mechanism 123 of rope lock 120 to unlock rope lock 120, releasing tension in rope implement 125 and allowing the user to relax user leg and remove their knee from physical stretching apparatus 100.

Figure 11:
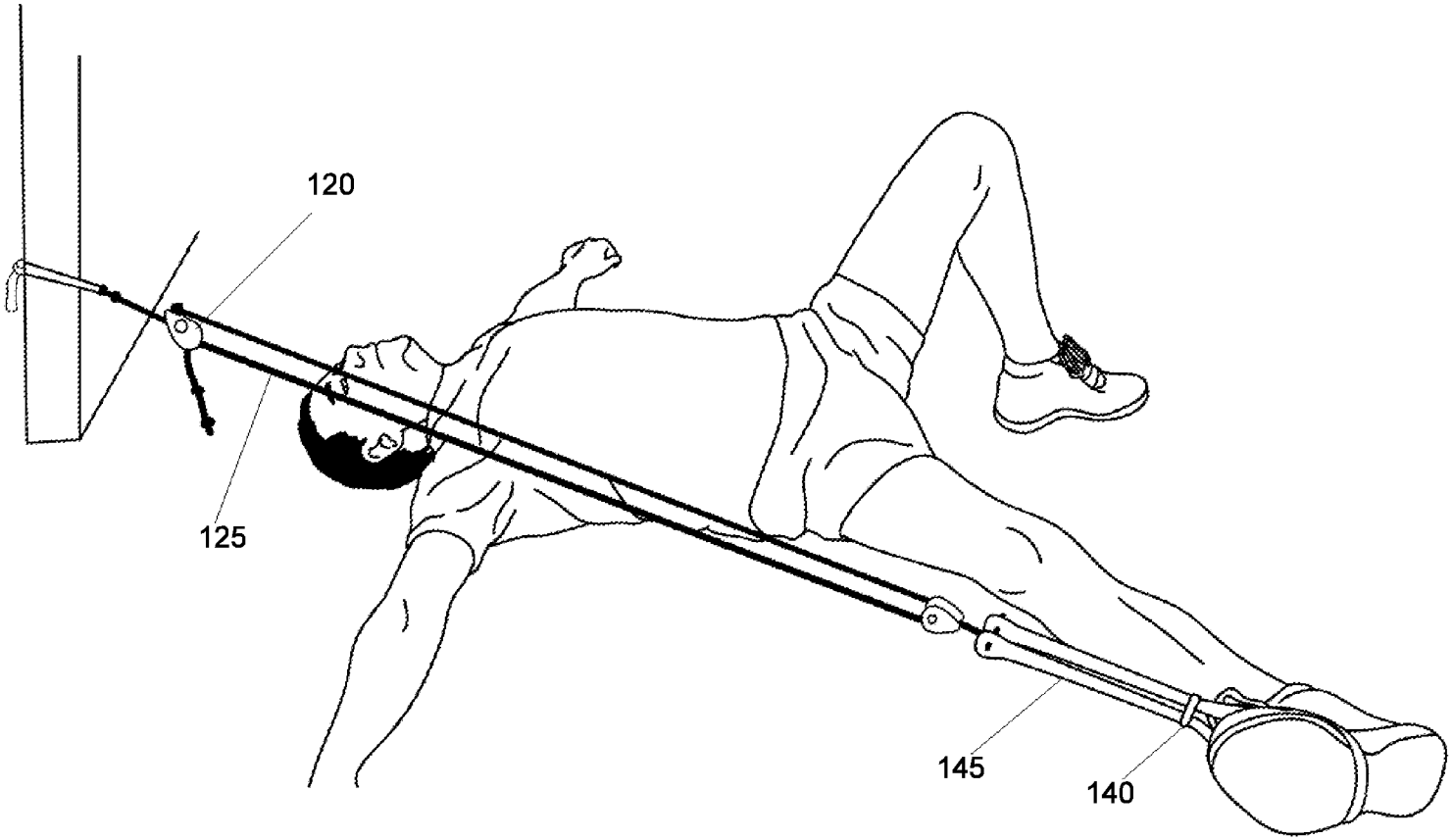
FIG. 11 illustrates an exemplary physical stretching apparatus used for an adductor stretch, in accordance with an embodiment of the present invention.

FIG. 11 illustrates an exemplary physical stretching apparatus used for an adductor stretch, in accordance with an embodiment of the present invention. With reference to both FIG. 1A and FIG. 11, a hip adductor stretch may also be performed using physical stretching apparatus 100. A user may insert their foot into looped strap 145 and adjust sliding restrainer 140 accordingly. With physical stretching apparatus 100 anchored to a stationary anchor, such as, for example a door, the user may extend their foot away from the center of their body, performing an adductor stretch. The user may hold the user's leg in the stretched position for a desired period of time or engage in alternating periods of leg tensioning and relaxation to counteract the elasticity of looped strap 145, simulating a particular technique of trainer assisted stretching. As rope implement 125 is locked in place via rope lock 120, less physical effort is required to perform the hip adductor stretch, as the user does not need to continually hold onto rope implement 125 while performing the stretch.

Figure 12:
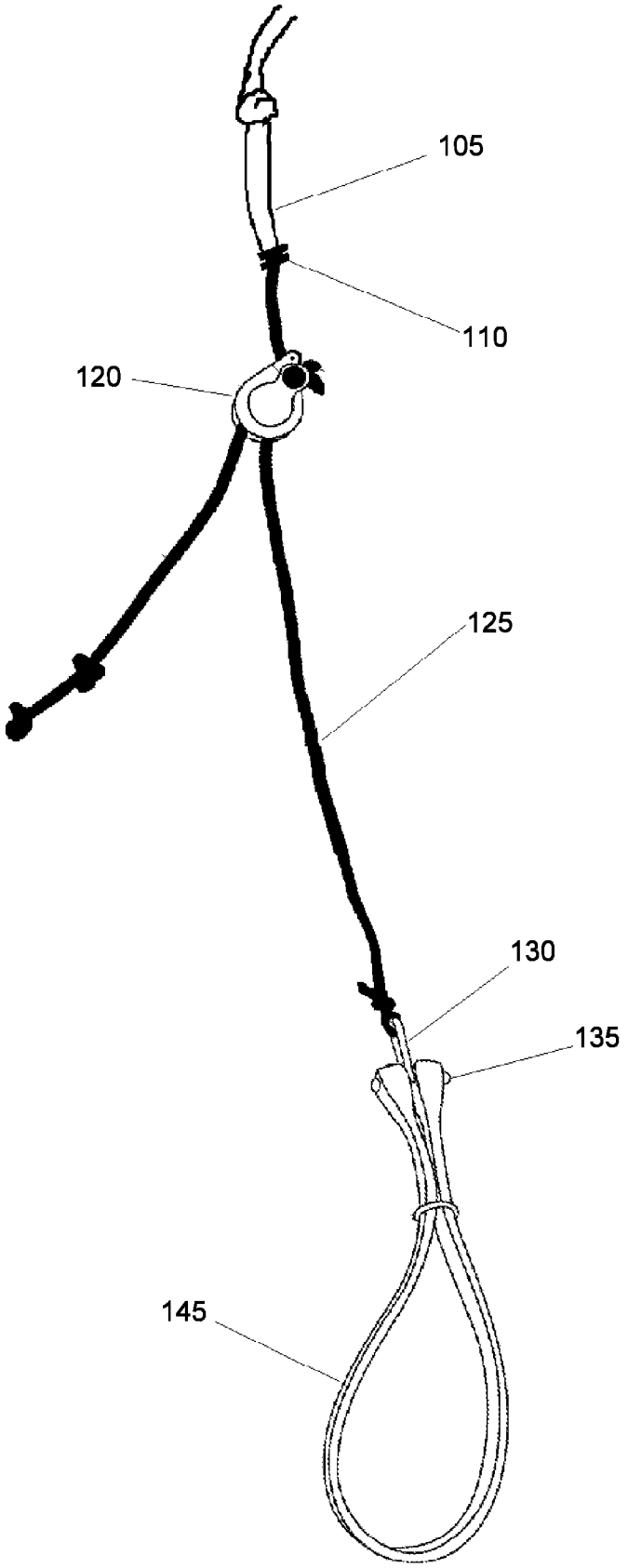
FIG. 12 illustrates an alternate exemplary physical stretching apparatus, in accordance with an embodiment of the present invention.

FIG. 12 illustrates another exemplary physical stretching apparatus, in accordance with an embodiment of the present invention with a one to one mechanical advantage pulley system. Anchor strap 105 and rope lock 120 of the apparatus may be attached to anchor joint 110. One end of rope implement 125 may be attached to looped strap 145 via attachment contrivance 130 at strap joint 135 or by any means known in the art, with the other end of rope implement 125 passing through rope lock 120.

Figure 13:
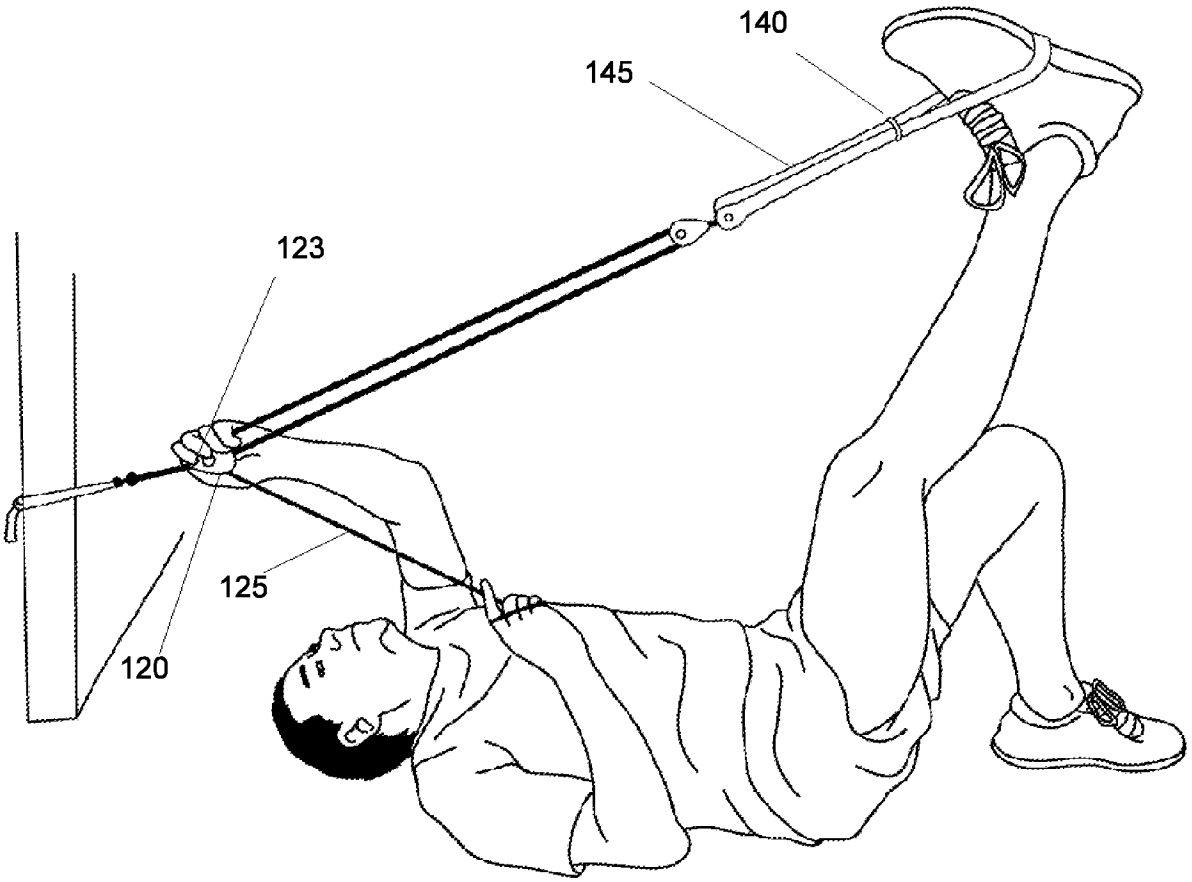
FIG. 13 illustrates an exemplary physical stretching apparatus being used to disengage from a hamstring stretch in accordance with an embodiment of the present invention.

FIG. 13 illustrates an exemplary physical stretching apparatus 100 being used to disengage from a hamstring stretch in accordance with an embodiment of the present invention. The user is depicted applying tension on the loose end of the rope implement 125 while simultaneously activating the release mechanism 123 of rope lock 120 then gradually releasing loose end of rope implement 125 to release user's leg from its stretched position. After attaining a comfortable non-stretched position, the user may let go of release mechanism 123 of rope lock 120 and the loose end of rope implement 125. The user may then adjust sliding retainer 140 and remove user foot from looped strap 145, thus disengaging from physical stretching apparatus 100.

While FIGS. 7-11 depict exemplary stretching exercises performed with physical stretching apparatus 100, as will be appreciated by one skilled in the art, additional stretching exercises may be performed using physical stretching apparatus 100, such as, for example, lower body stretches, upper body stretches, back stretches, neck stretches, arm stretches etc., Physical stretching apparatus 100 is not limited to being used for performing the stretches depicted in the figures provided.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. Thus, the present invention is not limited to any particular tangible means of implementation.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC § 112 (1), all claims must be supported by sufficient disclosure in the present patent specification, and any material known to those skilled in the art need not be explicitly disclosed. However, 35 USC § 112 (6) requires that structures corresponding to functional limitations interpreted under 35 USC § 112 (6) must be explicitly disclosed in the patent specification. Moreover, the USPTO's Examination policy of initially treating and searching prior art under the broadest interpretation of a "mean for" or "steps for" claim limitation implies that the broadest initial search on 35 USC § 112(6) (post AIA 112(f)) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC § 112(6) (post AIA 112(f)) when such corresponding structures are not explicitly disclosed in the foregoing patent specification. Therefore, for any invention element(s)/structure(s) corresponding to functional claim limitation(s), in the below claims interpreted under 35 USC § 112(6) (post AIA 112(f)), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC § 112(6) (post AIA 112(f)) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3rd parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC § 112(6) (post AIA 112(f)), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC § 112 (6). Applicant(s) note that all the identified documents above which are incorporated by reference to satisfy 35 USC § 112 (6) necessarily have a filing and/or publication date prior to that of the instant application, and thus are valid prior documents to incorporated by reference in the instant application.

Having fully described at least one embodiment of the present invention, other equivalent or alternative methods of implementing a physical stretching apparatus according to the present invention will be apparent to those skilled in the art. Various aspects of the invention have been described above by way of illustration, and the specific embodiments disclosed are not intended to limit the invention to the particular forms disclosed. The particular implementation of the physical stretching apparatus may vary depending upon the particular context or application. By way of example, and not limitation, the physical stretching apparatus described in the foregoing were principally directed to portable assisted stretching implementations; however, similar techniques may instead be applied to resistance training, rehabilitation from injuries and surgeries, mitigation of neurological issues, relief from common chronic back pain, inflammation of sciatica nerve issues, etc. which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. That is, the Abstract is provided merely to introduce certain concepts and not to identify any key or essential features of the claimed subject matter. It is submitted with the understanding that it will not be used to limit or interpret the scope or meaning of the claims.

The following claims are hereby incorporated into the detailed description, with each claim standing on its own as a separate embodiment.

Only those claims which employ the words "means for" or "steps for" are to be interpreted under 35 USC 112, sixth paragraph (pre AIA) or 35 USC 112(f) post-AIA. Otherwise, no limitations from the specification are to be read into any claims, unless those limitations are expressly included in the claims.

What is claimed is:

1. An apparatus comprising:

an anchor strap configured to be operable for attaching said apparatus to a door;

a rope implement;

an anchor joint configured to attach said anchor strap and said rope implement;

an elastic looped strap configured to secure said apparatus to various points on the user;

an attachment implement being an attachment contrivance and a strap joint as a single implement, wherein said attachment implement being configured to be operable for attaching said elastic looped strap to said rope implement, wherein said attachment implement comprises:

an arm portion configured to be operable for engaging said elastic looped strap;

a locking nut configured to engage said arm portion which is operable for engaging said elastic looped strap;

a shaft extending substantially perpendicularly from said arm portion; and a rope eye being a terminal extension of said shaft and configured to be operable for engaging said rope implement;

a rope lock configured to permit said rope implement to pass in one direction when pulled and restricts said rope implement from passing in an opposite or reverse direction;

a fastening knot, wherein said rope lock is attached to said anchor joint via said fastening knot which creates an obstacle configured to prevent said rope lock from slipping past said fastening knot, thereby holding said rope lock attached in series to said anchor joint when under tension; and a sliding restrainer configured to be operable for adjusting a size of said elastic looped strap.

2. The apparatus of claim 1, in which said rope lock comprises a release mechanism being configured to disable said restricted rope implement from passing in said-opposite or reverse direction.

3. The apparatus of claim 2, in which said anchor strap comprises an anchor knot which creates a second obstacle disposed on an approximate end of said anchor strap and adapted to prevent said anchor strap from slipping through a gap between a door slab and a door frame when said apparatus is affixed to the door.

4. The apparatus of claim 3, in which said anchor joint comprises at least one of: a crimp, a knot, a swivel, a ring, a hook snap, and a carabiner used to join said anchor strap to said rope implement.

5. The apparatus of claim 4, in which said rope lock comprises at least a pulley, wherein aid pulley generally permits said rope implement to pass in the one direction when pulled while restricting said rope implement from passing in the opposite or reverse direction.

6. The apparatus of claim 4, in which said rope lock further comprises at least a first pulley combined with a rope cleat, wherein said rope cleat is configured to permit said rope implement to pass in the one direction when pulled and wherein said rope cleat restricts said rope implement from passing in the opposite or reverse direction.

7. The apparatus of claim 5, in which said release mechanism is further configured to be deactivated by releasing a loose end of said rope implement.

8. The apparatus of claim 7, in which said sliding restrainer comprises a short piece of tubing, a ring, or buckle.

9. The apparatus of claim 3, in which said rope lock is a first pulley and said attachment implement comprises a rope implement wheel installed in the rope eye to enable a smooth transitioning of the rope implement.

10. An apparatus comprising:

an anchor strap configured to be operable for attaching said apparatus to a stationary object;

an anchor joint configured to attach said anchor strap and a rope implement;

an elastic looped strap configured to be operable for securing said apparatus to various points on the user;

an attachment implement being an attachment contrivance and a strap joint as a single implement, wherein said attachment implement being configured to be operable for attaching said elastic looped strap to said rope implement, wherein said attachment implement comprises:

an arm portion configured to be operable for engaging said elastic looped strap;

a locking nut section configured to engage said arm portion which is operable for engaging said elastic looped strap;

a shaft extending substantially perpendicularly from said arm portion; and a rope eye being a terminal extension of said shaft and configured to be operable for engaging said rope implement;

a rope lock configured to be operable for allowing said rope implement to pass in one direction when pulled and restricts said rope implement from passing in an opposite or reverse direction, wherein said rope lock comprises a release mechanism being configured to be operable for disabling said rope implement restriction;

a fastening knot, wherein said rope lock is attached to said anchor joint via said fastening knot which creates an obstacle configured to prevent said rope lock from slipping past said fastening knot, thereby holding said rope lock attached in series to said anchor joint when under tension; and a sliding restrainer configured to be operable for adjusting a size of said elastic looped strap.

11. The apparatus of claim 10, in which said anchor strap comprises an anchor knot disposed on an approximate end of said anchor strap and adapted to prevent said anchor strap from slipping through a gap between a door slab and a door frame when said stationary object is a door and said apparatus is affixed to the door.

12. The apparatus of claim 11, in which said anchor joint comprises at least one of: a crimp, a knot, a swivel, a ring, a hook snap, and a carabiner used to join said anchor strap to said rope implement; and said sliding restrainer comprises a short piece of tubing, a ring, or a buckle.

13. The apparatus of claim 12, in which said rope lock comprises at least a pulley combined with a rope cleat that is configured to be operable for allowing said rope implement to pass in said one direction when pulled while restricting said rope implement from passing in the opposite or reverse direction.

* * * * *